US006228168B1

(12) United States Patent
Johnson

(10) Patent No.: US 6,228,168 B1
(45) Date of Patent: May 8, 2001

(54) APPARATUS AND METHOD FOR AUTOMATED APPLICATION OF COATINGS TO SUBSTRATES

(75) Inventor: William A. Johnson, Hudsonville, MI (US)

(73) Assignee: Donnelly Corporation, Holland, MI (US)

( * ) Notice: Subject to any disclaimer, the term of this patent is extended or adjusted under 35 U.S.C. 154(b) by 0 days.

(21) Appl. No.: 09/127,415

(22) Filed: Jul. 31, 1998

(51) Int. Cl.[7] ..... B05C 1/02

(52) U.S. Cl. ..... 118/264; 118/266; 118/268; 118/255

(58) Field of Search ..... 118/255, 256, 118/264, 266, 268, 313, 323; 427/163.1, 165, 429; 401/148, 206, 264, 266, 272, 273, 203, 204

(56) References Cited

U.S. PATENT DOCUMENTS

| | | | | |
|---|---|---|---|---|
| 2,823,633 | * | 2/1958 | Meier et al. | 118/264 |
| 4,015,560 | * | 4/1977 | Paul | 118/323 |
| 4,295,439 | * | 10/1981 | Kruszona | 118/323 |
| 4,660,501 | | 4/1987 | Nagata et al. | 118/203 |
| 4,661,368 | * | 4/1987 | Rohde et al. | 118/523 |
| 4,683,836 | * | 8/1987 | West | 118/323 |
| 4,790,259 | | 12/1988 | Morris et al. | 118/707 |
| 4,947,580 | | 8/1990 | Moore | 47/1.5 |
| 5,131,349 | | 7/1992 | Keller et al. | 118/73 |

* cited by examiner

*Primary Examiner*—Laura Edwards
(74) *Attorney, Agent, or Firm*—Van Dyke, Gardner, Linn & Burkhart, LLP

(57) ABSTRACT

An automated priming system and method for applying a liquid, such as a primer or treatment liquid, to a substrate provides a surface variation sensitive applicator assembly which applies a constant pressure to the substrate during the liquid application process and, therefore, provides a process which achieves a more uniform application path and coating thickness. The automated system includes a robot and at least one applicator assembly. The applicator assembly includes a base and an applicator tip mounted to the base. The applicator tip is adapted to receive a supply of liquid. The robot holds the base of the applicator and positions the applicator tip on the substrate for applying a liquid onto the substrate. One of the applicator and the robot is adapted to apply a constant pressure to the substrate during the application process. The method provides supporting a substrate, holding a applicator assembly, positioning the applicator assembly on the substrate, directing a liquid on to the substrate through the applicator assembly, and storing the applicator assembly between applications in fixed location. Optionally, in primer applications, the applicator is stored in an environment which prevents premature hardening of the primer in the applicator assembly. For example, the applicator assembly may be preferably stored in docking station, which optionally includes a reservoir for holding a primer solution solvent and a vapor port in communication with the reservoir. The applicator is stored in the vapor port such that the solvent vapors prevent premature hardening of the primer solution in the applicator.

31 Claims, 6 Drawing Sheets

APPARATUS AND METHOD FOR AUTOMATED APPLICATION OF COATINGS TO SUBSTRATES

TECHNICAL FIELD AND BACKGROUND OF THE INVENTION

The present invention relates to a method and apparatus for applying a liquid to a substrate and, more particularly, to an automated method and apparatus for applying one or more liquids, including for example a primer coating or a treatment liquid, to a glass panel, such as a window assembly.

The recent trend in vehicles is to produce an aerodynamically shaped vehicle with larger windows to improve visibility. In order to reduce the aerodynamic drag and enhance the overall appearance, window assemblies are more recently mounted to the vehicle body by an adhesive, often in combination with one or more fasteners which are mounted to an inner surface of the window panel or are embedded in a gasket which has been previously extruded or molded on to the window panel after priming of the substrate surface. It has been found that the priming of the substrate surface improves the adhesion of the gasket to the substrate. The adhesive is applied to the surface of the panel or the gasket, for example by extrusion. To install, the window assembly is then pressed against the mounting flange or decking of the vehicle body to which the adhesive adheres after curing. In other windows, the securement of the window panel to the vehicle is achieved by a fastening system. In some fastening systems, the fastener is adhered directly to the surface of the window by an adhesive. Before applying such adhesives, the window panel is preferably treated with a treatment liquid, such as an acid solution or cleaning solution, to prepare the glass panel and improve the adhesion of the adhesive to the glass panel. In many windows, therefore, the adhesive often provides the primary attachment of the panel to the vehicle.

However, window assemblies often include compound curvatures, which make it hard to automate the application of the gasket primer or treatment liquid. In preferred forms, the primer or treatment liquid is directly applied to the window substrate rather than sprayed or wiped on in order to achieve a more uniform coverage and thickness. As a result of the compound curvatures and the irregularities in the surface topology of window panels, direct application of a primer or treatment liquid to a window assembly has been more typically accomplished manually with the use of an applicator.

Conventional applicators include a tip, for example a pad, including a felt pad, and a reservoir which holds a supply of the primer solution or treatment liquid. However, when applying a liquid that dries when exposed to air, such as most conventional primers, the pads of the applicators must be replaced frequently. For example, primers dry relatively quickly in ambient conditions and tend to harden the pad and clog up the applicator. As a result, applicator tips or pads require frequent replacement, and the applicator reservoir must be cleaned and flushed before refilling.

As described above, heretofore, manual application of the primer has been preferred due to the compound curvatures and irregularities in the surface topology of the window assembly substrate and more consistent results due to varying conditions of the substrate (i.e. frit, contamination, temperature, or the like). Furthermore, it has been found that in order to achieve optimal results, the liquid is preferably applied with a constant pressure so that a uniform coating can be achieved. Heretofore, this constant pressure has been easier to achieve with manual application. However, manual application may result in inaccurate primer or treatment liquid placement and the coating thickness may vary with each worker. Moreover, conventional primer systems are open systems which result in prolonged exposure of the primer to contaminants. Given the reactive nature of primer solutions, these open systems cause the primer solution to prematurely cure. Therefore, these open primer systems are wasteful and require frequent cleaning and or replacement of the applicators.

Consequently, there is a need for a liquid application system which will produce the same advantages of a manually applied coating system, including a substrate surface and substrate condition variation sensitive system, but will require less material usage and, consequently, produce less waste than a manual application process. Furthermore, there is a need for a liquid application system that will provide a longer life for the applicator tip. In addition, there is a need for a primer application system which can provide a highly accurate primer or treatment liquid placement and produce a repeatable coating thickness. Moreover, there is a need for a closed primer system which will reduce waste and increase the life of the applicator and further reduce contamination of the treatment liquid or primer solution.

SUMMARY OF THE INVENTION

The present invention provides a method and apparatus for applying a liquid, such as a treatment liquid or primer, to a substrate with an applicator assembly, which is responsive to variations in the characteristics and surface topology of the substrate. Preferably, the primer applicator assembly can apply the liquid to the substrate with a constant pressure so that the applied liquid will have a uniform shape and thickness. Furthermore, when used in a primer application process the present invention provides a liquid applicator system which prevents the premature hardening of the primer solution in the applicator and, consequently, increases the life of the applicator. Moreover, the primer applicator assembly permits automation of the liquid application process and, therefore, can provide a highly accurate coating placement and produce a repeatable application path and coating thickness. In addition, the applicator system provides a closed system that is particularly suitable for applying primers which eliminates or substantially reduces the contamination of the liquid and the amount of volatiles which escape from conventional primer solutions.

In one form, an applicator assembly for use in an automated liquid application system for applying a liquid to a substrate includes a base, which is adapted to be gripped by a holding member, and a liquid applicator. The applicator is moveably mounted on the base and is adapted to receive a supply of liquid and is positionable on the substrate by the holding member for applying the liquid to the substrate. The liquid applicator moves on the base to follow the contour of the substrate thereby applying constant pressure to the substrate during a liquid application process.

In one aspect, the base includes a pin, with the liquid applicator being slidably mounted on the base by the pin. Preferably, the liquid applicator is mounted on the pin by an adapter, which includes a transverse supply passage for receiving the liquid. The applicator is mounted to the adapter and is communication with the transverse supply passage for receiving the liquid. In further aspects, the adapter includes a liquid applicator fitting mounted thereon, with the applicator fitting including the liquid applicator. In another aspect, the applicator includes a mounting portion, a flange portion, and an applicator tip coupled to the flange portion. Preferably, the applicator fitting extends into the mounting portion of the liquid applicator and is coupled thereto by a friction fit so that the applicator is removably mounted to the applicator fitting. In preferred form, either the applicator fitting or the mounting portion includes an annular seal to provide a fluid type connection between the applicator fitting and the liquid applicator and, optionally, to provide the friction fit. In further aspects, the applicator tip preferably comprises a pad, for example a felt pad, which absorbs the liquid for directly applying the liquid onto the substrate.

In yet further aspects, the base includes a pair of flanges, which provide stops and limit the movement of the adapter between a first position and a second position along the pin. Optionally, the applicator assembly may further include a biasing member which is mounted on the pin and positioned between one of the flanges and the adapter to bias the applicator for contacting the substrate with a constant pressure, which is especially suitable for applications in which the substrate is vertically oriented.

In yet another aspect, the applicator assembly further includes a liquid supply line, which is coupled to the adapter and delivers liquid to the liquid applicator through the transverse supply passage. Preferably, the liquid supply line is coupled to the adapter by a supply line fitting, for example a male fitting.

In one aspect, the base is coded to uniquely identify the applicator assembly. For example, the base may be mechanically coded, such as by providing the base with a projecting rib. Furthermore, the base may include a second projecting rib for further providing mechanical coding of the applicator assembly. Alternately or in addition, the base may include one of a plurality of holes, a plurality of recesses, or a magnetic strip or strips or the like for coding the applicator assembly.

According to another form of the invention, an automated liquid applicator system for applying a liquid to a substrate includes a robot having a movable gripper and at least one liquid applicator assembly. The liquid applicator assembly includes a base and an applicator tip which is mounted to the base and which is adapted to receive a supply of liquid. The gripper holds the base and positions the applicator tip on the substrate for applying a liquid onto the substrate. Preferably, either the applicator assembly or the robot is adapted to apply constant pressure to the substrate during the application process.

In further aspects, the automated priming system includes a docking station. The docking station optionally includes a reservoir and a port in communication with the reservoir. When automated priming system is used for applying a primer, the reservoir holds a solvent for preventing premature hardening of the primer solution in the applicator tip. The robot positions the applicator tip in the port between applications of the primer solution onto the substrate, thereby extending the life of the applicator tip.

In yet further aspects, the applicator assembly is preferably adapted to apply a constant pressure to the substrate when the applicator tip applies the liquid onto the substrate. For example, the applicator tip may be movably mounted on the base, whereby the applicator tip follows the contours of the substrate which results in the applicator tip applying a constant pressure to the substrate. In further aspects, the applicator tip is slidably mounted on the base by a pin. Preferably, the applicator assembly includes an adapter which slidably mounts the applicator tip on the pin. The adapter includes a transverse supply passage for receiving the liquid, with the applicator tip being mounted to the adapter and being in communication with the transverse supply passage for receiving the liquid.

In another form, an automated priming system for applying a primer to a substrate includes a robot, a primer delivery system, at least one applicator assembly, and a docking station. The robot includes a movably arm and a gripper mounted to the movable arm. The applicator assembly includes a base and an applicator tip mounted to the base, with the applicator tip being adapted to receive a primer solution from the primer deliver system through a supply line. The gripper holds the base and positions the applicator tip on the substrate for applying the primer solution onto the substrate with one of the applicator assembly and the robot being adapted to apply constant pressure to the substrate with the applicator tip during a primer application process. The docking station includes a reservoir, which holds a solvent that prevents the primer solution from hardening, and a port, which is in fluid communication with the reservoir. The robot positions the applicator tip in the port of the reservoir between applications of the primer solution on to the substrate to prevent the primer solution in the applicator tip from hardening between applications.

In one aspect, the primer supply system includes a primer reservoir for holding a supply of primer solution and a delivery pump for delivering the primer solution to the applicator assembly through the primer supply line. For example, the delivery pump may comprise a peristaltic delivery pump. Preferably, the primer supply system includes a recirculating pump, which recirculates primer solution through the primer reservoir to maintain the homogeneous properties of the primer solution.

In further aspects, the automated priming system comprises a plurality of the applicator assemblies, with each of the applicator assemblies being coded to uniquely identify the respective applicator assemblies. Furthermore, the automated priming system preferably includes a corresponding plurality of primer supply systems, wherein each of the applicator assemblies is associated with a respective primer supply system.

According to yet another form of the invention, a method of applying a liquid to a substrate includes supporting a substrate, holding a liquid applicator assembly, which includes a liquid applicator and is adapted to apply a constant pressure to the substrate, positioning the liquid applicator assembly on the substrate, directing a liquid onto the substrate through the applicator assembly and liquid applicator, and storing the applicator assembly between applications in a fixed location.

In further aspects, the method includes coupling the applicator assembly to a primer supply system. Preferably, the primer solution is recirculated through the primer supply system to maintain the homogeneous properties of the primer solution. In one aspect, the method further includes storing the applicator assembly in an environment which prevents premature hardening of a primer solution in the applicator assembly.

In other aspects, the method includes providing a plurality of applicator assemblies and selecting one of the applicator assemblies for applying a first liquid solution to the substrate. Preferably, the applicator assemblies are coded whereby each applicator assembly is uniquely identifiable.

In yet other aspects, the method further provides a robot with a gripper, wherein the applicator assembly is held by the gripper of the robot. Further, the method includes providing a docking station with a reservoir and a port in fluid communication with the reservoir. A liquid primer solution solvent is held in the reservoir, which prevents premature hardening of a primer solution in the applicator. The applicator is stored in the port of the reservoir with the applicator being adjacent and engaging the solvent vapors but out of contact with the liquid solvent so that the primer solution in the applicator assembly does not prematurely harden.

The improved apparatus and method disclosed herein provides for an automated system of applying a liquid, such as a primer solution or a treatment liquid, to a substrate, for example a window assembly. The automated applicator system incorporates a liquid applicator assembly that is adapted to follow the contours of the substrate in order to apply a constant pressure to the substrate when applying the liquid. Furthermore, the automated system of the present invention optionally provides a closed loop system, thus, reducing waste and the risk of ambient contamination for the liquid, which is especially suitable for most conventional primer solutions. Moreover, the application system includes a docking system for holding the applicator assemblies in a fixed location and which optionally includes a reservoir for holding a primer solution solvent that prevents the applicable primer solutions in the applicator assemblies from prematurely hardening. In addition, in preferred form, the application system of the present invention utilizes a robot which is adapted to hold the applicator assemblies and provides a more accurate placement of the liquid on the substrate.

DESCRIPTION OF THE PREFERRED EMBODIMENTS

Figure 1:
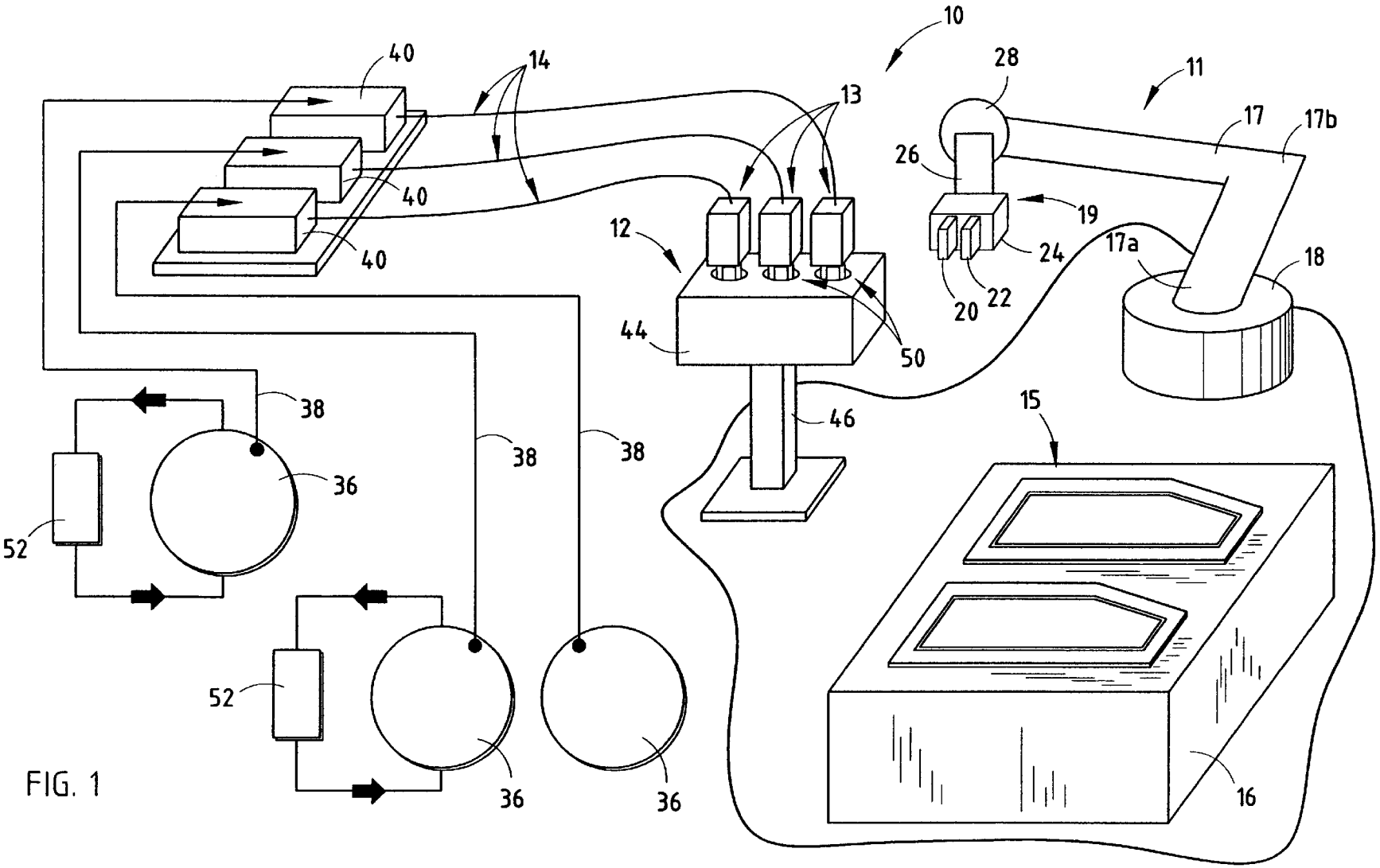
FIG. 1 is a schematic representation of an automated liquid applicator system of the present invention.

Referring to FIG. 1, the numeral 10 generally designates an automated liquid applicator system of the present invention which is particularly useful for applying a liquid, such as a treatment liquid or a primer solution, to a substrate, such as a glass window panel. Such treatment liquids include acid solutions or cleaning solutions or the like. Automated liquid applicator system 10 includes a robot 11, a docking station 12, one or more applicator assemblies 13, and a corresponding number of liquid supply systems 14, which deliver treatment liquid or a primer solution or solutions to the respective applicators for applying the respective liquid onto a substrate 15, for example a window assembly. Substrate 15 is preferably supported on a table or conveyor 16 in a fixed position and/or positively located in such a way as to ensure repeatability of the application of the liquid by robot 11. As will be more fully described, robot 11 grips and removes an applicator assembly 13 from docking station 12 and moves applicator assembly 13 onto substrate 15 for applying a treatment liquid or primer solution onto a portion of substrate 15 in a pre-programmed pattern and sequence. Furthermore, each applicator assembly 13 is preferably uniquely coded and positively located in docking station 12 so that robot 11 can uniquely identify and locate each applicator assembly 13 to assure that the correct liquid is applied to substrate 15. Each applicator assembly 13 includes an applicator 13*a* with an applicator tip 13*b*, such as a pad, including felt pad, which absorbs the treatment liquid or primer solution so that the liquid can be directly wiped onto substrate 15. After completing the pre-programmed sequence, robot 11 returns applicator assembly 13 to docking station 12 in order to positively locate the applicator with respect to a selected coordinate system, for example an "x/y/z" coordinate system. Further, in primer application processes, the applicator is returned to docking station to prevent premature hardening of the solvent in the applicator and applicator pad as will be more fully described below. In addition, automated liquid applicator system 10 is adapted to positively locate the portion of the panel to be treated and to apply a constant pressure to the substrate despite the curvature of the substrate and variations in the surface topology of the substrate, which will also be more fully described below.

Robot 11 is a conventional robot and in preferred form comprises an ABB IRB 4400 or similar model commercially available from ABB Robotics Products AB of Västeras, Sweden. Robot 11 includes an articulating arm 17 which is optionally supported on a base 18, which is typically mounted to a floor of a factory or assembly plant. Alternately, base 18 can be mounted to a wall, a ceiling, or support frame. Articulating arm 17 is movable about one or more joints 17*a*, 17*b* to a plurality of positions for retrieving and gripping applicator assemblies 13 from docking station 12 and for moving the respective applicator assembly over to substrate 15 and for moving the applicator assembly on substrate 15 to directly apply the liquid. Articulating arm 17 holds or grips applicator assemblies 13 by a holding member, such as a gripper or gripper assembly 19, which is mounted to the free end of articulating arm 17.

Figure 4:
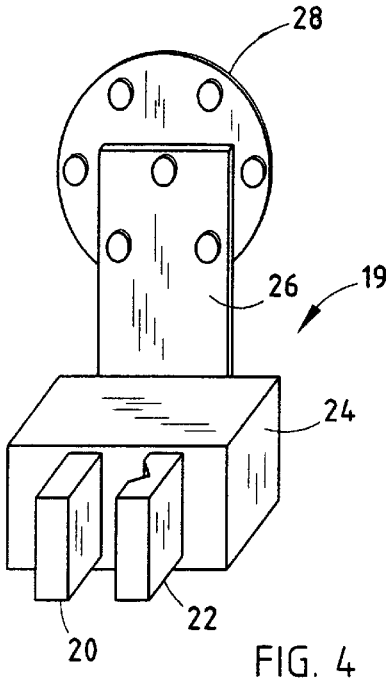
FIG. 4 is an enlarged view of the gripper assembly and its mounting arrangement of FIG. 1.
Figure 4A:
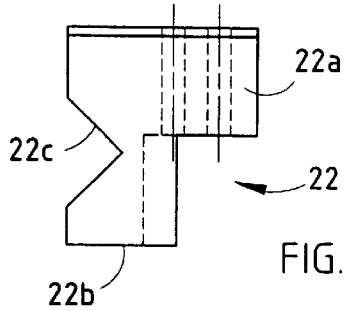
FIG. 4A is an enlarged top plan view of a first gripper jaw of the gripper assembly of FIG. 4.
Figure 4B:
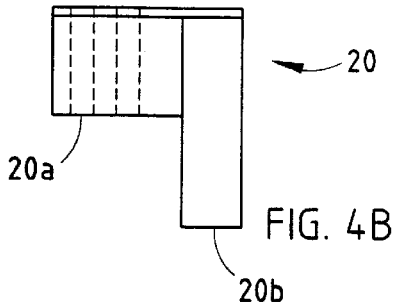
FIG. 4B is an enlarged top plan view of a second gripper jaw of the gripper assembly.

Referring to FIGS. 4, 4A, and 4B, gripper assembly 19 includes a pair of gripper members or jaws 20 and 22 which are mounted on a pneumatic parallel gripper actuator 24. Pneumatic parallel gripper actuator 24 moves gripper jaws 20 and 22 toward or away from each other in a substantially parallel relationship for gripping an applicator assembly 13 and for holding applicator assembly 13 therebetween so that robot 11 can pick up a respective applicator assembly 13 and move applicator assembly 13 from docking station 12 to table or conveyor 16 for applying the liquid to substrate 15. Parallel gripper actuator 24 is commercially available under Part No. GPT-151A 21-A from Parker of Wadsworth, Ohio. Gripper assembly 19 includes a gripper mounting bracket or adapter 26 which is rotatably mounted on articulating arm 17 by a robot mounting bracket or adapter 28. Each gripper jaw 20, 22 includes a mounting portion 20*a*, 22*a*, respectively, for mounting to actuator 24, and a gripping portion 20*b*, 22*b*, respectively, for engaging the respective applicator assembly. Preferably, at least one gripper jaw 22 includes a groove or recess 22*c* on its gripping portion which matches the profile of the respective applicator assembly 13. As will be more fully explained, each applicator assembly 13 is preferably coded, for example by mechanical coding, so that robot 11 can confirm whether the correct applicator assembly has been located and, furthermore, so that when handled by an operator, the operator can confirm that he or she has properly located the applicator assembly and no mistake can be made.

In preferred form, automated liquid applicator system 10 includes one or more designated applicator assemblies 13. Furthermore, each applicator assembly 13 may be designated for applying a selected liquid to substrate 15 and is, therefore, in fluid communication with a designated liquid supply system 14, which supplies applicator assembly 13 with its respective liquid for application onto substrate 15. In addition, in primer application processes, docking station 12 optionally includes a reservoir 42 and a plurality of vapor ports 50 in fluid or vapor communication with reservoir 42 which (which will be more fully described below) correspond to the number of applicator assemblies. Preferably, docking station 12 includes one or more positioning assemblies 110 which are keyed or coded to a respective applicator assembly 13, as will be more fully explained below, so that each applicator assembly 13 is associated and positionable in a unique position on docking station 12 and, optionally, in a unique port 50. In this manner, control system 10 is error proofed so that when an operator sets up the system, each applicator assembly 13 can only be positioned in its correct location on docking station 12. Therefore, automated liquid is error proofed in its application process and in its set-up procedures.

Figure 2:
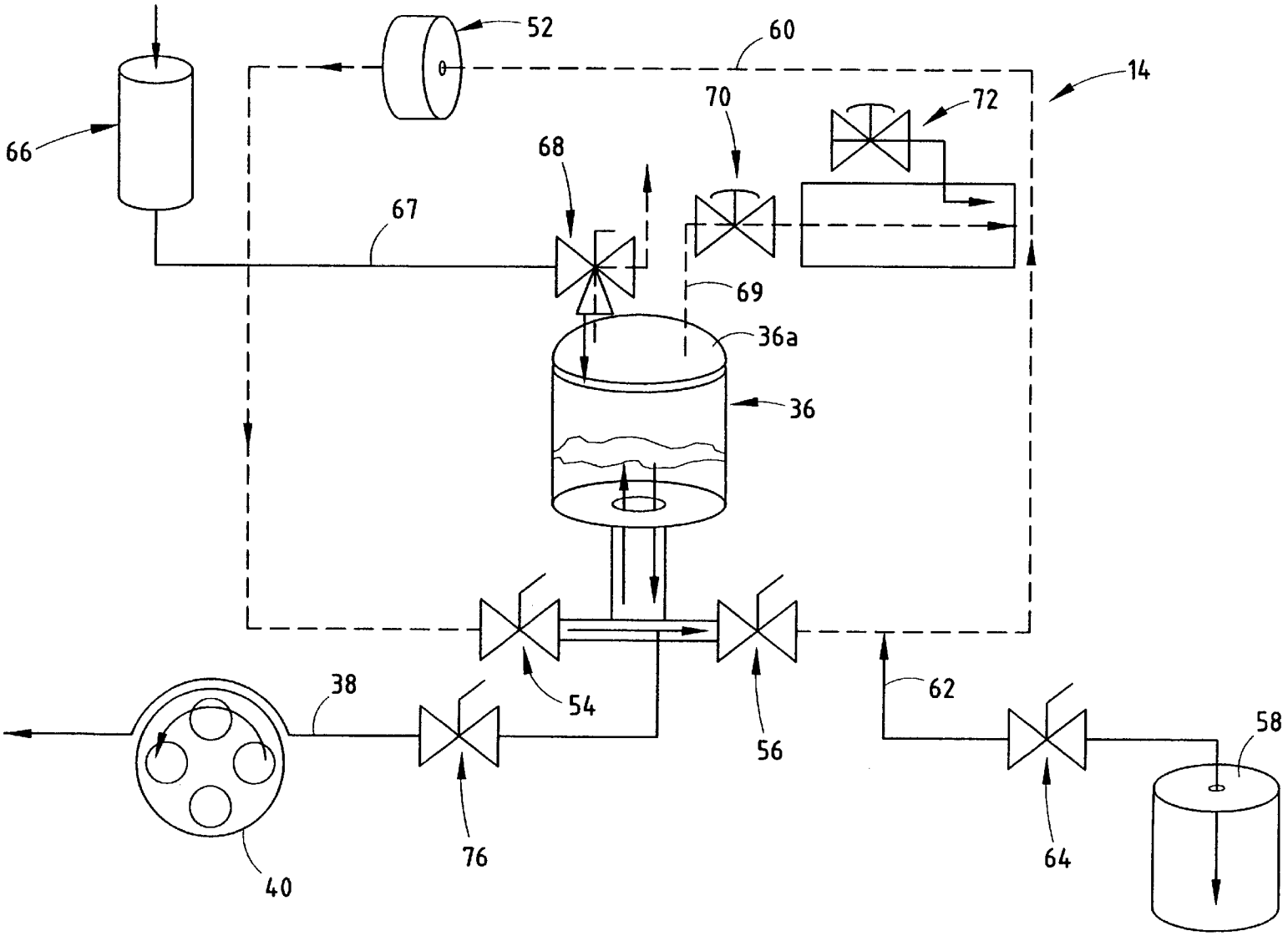
FIG. 2 is a schematic flow diagram of a recirculation liquid applicator supply system of the present invention.

Referring to FIGS. 1 and 2, a supply system 14 is illustrated which includes a respective reservoir 36 and is preferably in communication with its respective applicator assembly 13 via a supply or delivery line 38, for example a flexible conduit such as tubing, including flex tubing. Furthermore, each supply or delivery line 38 includes a respective delivery pump, preferably a peristaltic pump 40, which delivers liquid to its respective applicator assembly 13 from its respective reservoir 36. Peristaltic pumps 40 provide a pulsating flow of the liquid to their respective applicator assemblies 13 to ensure that the liquid, such as a primer solution, in the respective supply or deliver lines 38 does not create a build up in the lines, which could eventually restrict the flow of the liquid to the respective applicator assembly 13. Furthermore, when applying the liquid onto substrate 15, the respective peristaltic pump 40 preferably pumps at a rate to ensure adequate coverage of the area to be treated or primed, for example at a rate of about 2.0–20 gm/min. typically.

Referring to FIG. 2, each supply system 14 optionally includes a recirculating pump 52, which maintains the homogeneous properties of the liquid by recirculating the liquid in the reservoir 36 through a recirculation line 60. Positioned between the outlet of recirculating pump 52 and the inlet of reservoir 36 is a return valve 54 which allows adjustment of the recirculation rate of the liquid. Preferably, return valve 54 is adjusted to maintain the recirculation rate in a range of about 30 to 60 beats per minute. Positioned between reservoir 36 and the inlet to recirculation pump 52 is a supply valve 56, which is normally kept open for normal recirculation but closed when reservoir 36 is filled. Reservoir 36 is filled from a supply source such as a supply can 58 which is in fluid communication with the recirculation line 60 through a supply line 62. Supply line 62 includes a drain or draw valve 64 which is normally in the closed position unless reservoir 36 is being filled by supply can 58. Supply system 14 further preferably includes an air desiccant 66 through which the air from the reservoir 36 is circulated through air line 67 via dry air supply vent valve 68. Desiccant 66 dries the incoming air through the air vent 68 (reservoir 36 vents to atmosphere through air vent 68 ) to reduce or eliminate contamination of the respective liquid. Furthermore, supply system 14 preferably includes a vent line 69, a draw vent valve 70, and a vacuum run valve 72 which is used to vacuum air draw the moist air out of reservoir 36, in the event the top or lid 36*a* of reservoir 36 is removed for cleaning or inspection. Again, by venting the moist air out of reservoir 36, contamination of the respective liquid is significantly reduced or eliminated. The liquid which is stored in reservoir 36 is delivered to peristaltic pump 40 by supply line 38 through a processing supply valve 76.

When the liquid solution is drawn from supply can 58, draw valve 64 is opened and supply valve 56 is closed so that the liquid will pass through recirculation pump 52 before entering reservoir 36. Furthermore, when reservoir 36 is being filled, vent valve 68 vents air from reservoir 36 to maintain the pressure in the reservoir generally constant and, preferably, to maintain reservoir 36 at one atmosphere. Preferably, process supply valve 76 is in the normally open position in order to supply liquid at zero pressure to the peristaltic pump 40. In this manner, recirculation supply system 14 is a closed loop system which maintains the homogeneous properties of the liquid and maintains the liquid in a dry environment thus minimizing or eliminating premature curing of liquids, such as primer solutions, while maintaining the liquid ready for delivery to the respective applicator assembly 13.

The illustrated system 14 is primarily directed to a liquid applicator system that applies primer solutions. It should be understood that supply system 14 may be varied or simplified as needed depending on the particular liquid being applied to the substrate.

Figure 3A:
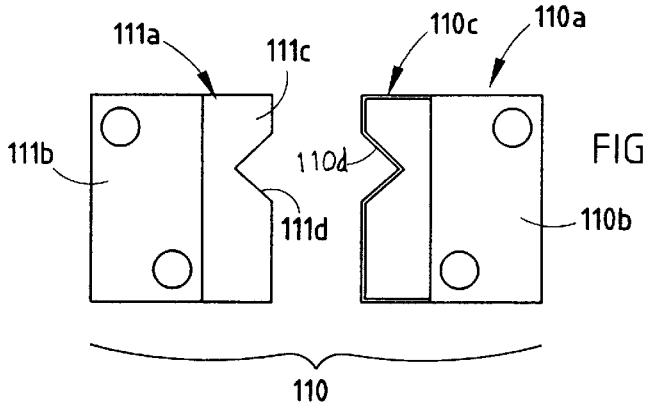
FIG. 3A is an enlarged top plan view of receiving members of the docking station.
Figure 3:
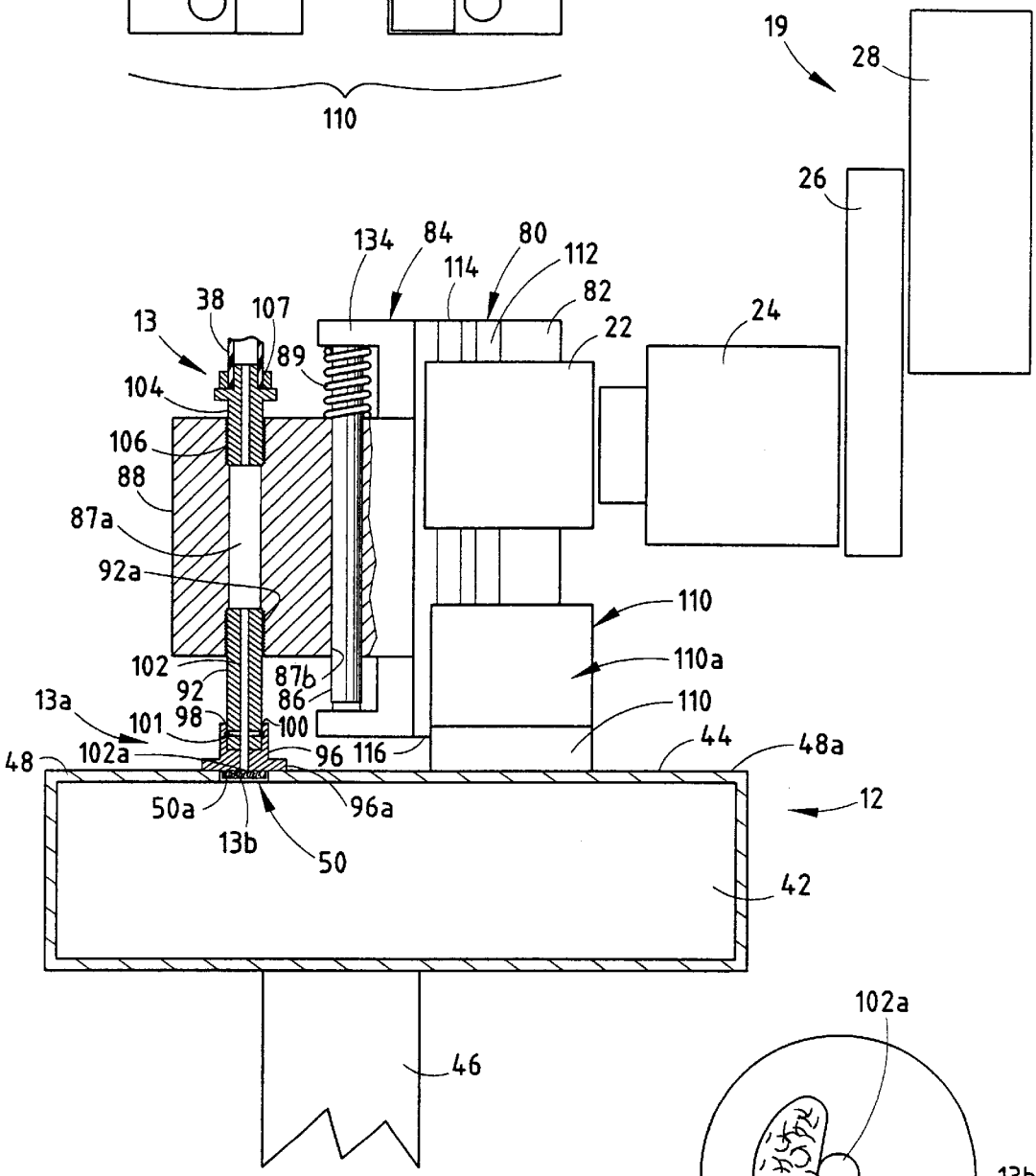
FIG. 3 is a partial fragmentary view of the robot positioning the applicator on a docking station.
Figure 3B:
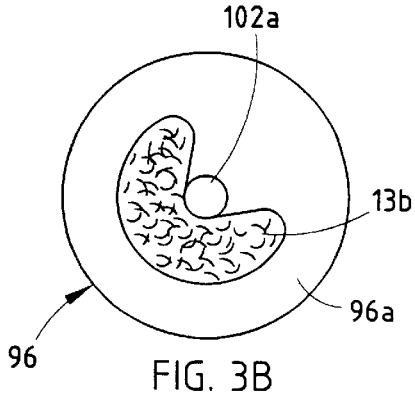
FIG. 3B is an enlarged bottom plan view of the applicator of FIG. 3.

As referenced above, where system 10 applies one or more primer solutions, each applicator assembly 13 is stored and held in docking station 12 between applications to prevent the premature hardening of the primer solution in the respective applicator tip 13*b*. Referring to FIG. 3, docking station 12 includes tank or reservoir 42 which holds a suitable solvent, such as methyl ethyl ketone (MEK) or the like, which prevents the premature hardening of the respective primer in the applicator 13*a* and applicator tip 13*b*. Docking station 12 includes a housing 44, which defines the reservoir 42, and a pedestal 46 on which housing 44 is supported. Pedestal 46 is typically mounted to the flooring of a factory or assembly plant and is preferably located in relatively close proximity to the table or conveyor 16 so that robot 11 using gripper assembly 19 may lift a respective applicator assembly 13 from reservoir tank 42 for applying its respective liquid onto the substrate 15. Housing 44 includes a lid or top wall 48 which includes a vapor port 50 for each respective applicator assembly 13. Each vapor port 50 includes an opening 50*a* which matches the size of applicator tip 13*b* so that the solvent in reservoir 42 is in proximity to, but preferably out of contact with tip 13*b*. The vapors from the solvent in reservoir 42 maintain the primer solution absorbed into tip 13*b* in liquid form and prevents hardening of the primer solution so that tips 13*b* will remain generally pliable for continued use, thereby extending the life of applicator tips 13*b*. In this manner, automated liquid applicator system 10 reduces waste and extends the life of applicators which are used for priming substrates. Furthermore, when automated liquid applicator system 10 uses a robot for applying the treatment liquid or primer, primary system 10 achieves greater accuracy in the placement of the liquid. Moreover, the automated liquid applicator system 10 achieves repeatable liquid delivery to the respective applicator and a repeatable liquid coating thickness. In addition, automated primer system 10 allows for multiple liquids and/or primers to be applied with a single robot.

As described above, applicator 13 is preferably adapted to apply a constant pressure to substrate 15 when applying its respective liquid. Referring to FIGS. 3 and 5–12, each applicator assembly 13 includes a base 80 which includes a central web 82 and a C-shaped portion 84. Web 82 includes a stop flange 82*a* (FIG. 7) on its upper end so that when base 80 is gripped by gripper assembly 19 base will rest on jaws 20 and 22 in the event that robot 11 does not achieve full engagement with base 80. C-shaped portion 84 includes a slide shaft 86 on which a fluid adapter or fluid block 88 is slidably mounted. Fluid adapter 88 includes a first transverse passage 87*a* through which the liquid is delivered to applicator 13*a* and a second transverse passage 87*b* which receives shaft 86. As best seen in FIG. 3, applicator 13*a* is mounted on fluid adapter 88 by an adapter member 92, which includes a threaded portion 92*a* for threadingly engaging and coupling to a first end of transverse passage 87*a* of fluid adapter 88. Applicator 13*a* includes an annular collar 96 (FIG. 3) which is mounted on an end portion 92*b* of adapter 92 and, preferably, releasably mounted to adapter 92 by, for example, a friction fit. In order to provide a fluid tight connection between collar 96 and adapter member 92, one of collar 96 and adapter 92 includes an annular seal 98. Preferably, annular seal 98 is positioned in an annular groove 100 provided on the inner surface of collar 96. In addition, annular seal 98 optionally registers with a respective annular groove 101 provided on adapter 92 and may provide the friction fit between collar 96 and adapter member 92 so that collar 96 can be easily removed for service or replacement. Extending through adapter member 92 and collar 96 is a common transverse passage 102 which forms a delivery passage and orifice 102*a* for the respective applicator. Transverse passage 102 is in fluid communication with transverse passage 87*a* of fluid adapter 88 and delivers liquid to tip 13*b* through orifice 102*a*. Tip 13*b* is aligned with passageway 102 and orifice 102*a* and is mounted to a flange portion 96*a* of collar 96 by, for example, an adhesive or press fit. The liquid is delivered to transverse passage 87*a* and transverse passage 102 via delivery line 38 which is interconnected to fluid block 88 via a fluid coupler 104. Fluid coupler 104 may, for example, comprise a male coupler which includes a threaded portion 106 for threadingly engaging the upper portion of transverse passage 87*a* and a nozzle 107 for coupling in a conventional manner to delivery line 38. Extending through coupler 104 is a similar transverse passage 108 which permits the liquid to be delivered from delivery line 38 through transverse passages 108, 87*a*, and 102 to tip 13*a*. Each delivery passage 102 and orifice 102*a* may be sized according to the specific application. It should be understood that the size of the orifice can vary with each treatment liquid or primer solution. Applicator 13*a* is commercially available from Designetics of Sylvania, Ohio.

As described previously, in primer application processes docking station 12 includes reservoir 42 which optionally holds a suitable solvent to prevent the premature hardening of a primer solution and, therefore, prevents premature hardening of tip 13*b*. As best seen in FIG. 3, when applicator 13 is positioned on docking station 12, tip 13*a* is positioned in vapor port 50 and flange portion 96*a* of collar 96 rests on a top surface 48*a* of upper wall or lid 48 of tank 12 so that tip 13*a* is substantially positioned in and closed in vapor port 50. The volume of solvent within reservoir 42 is preferably such that the tip 13*b* does not come in direct contact with the solvent and, instead, is adjacent and in sufficiently close proximity to the liquid solvent so that tip 13*a* is exposed to the volatile vapors from the solvent to maintain the primer solution which is in tip 13*a* from premature hardening and, therefore, extends the life of the applicator tip 13*a*.

Referring to again FIG. 3 and to FIGS. 6–12, base 80 is adapted for gripping by gripper jaws 20 and 22 and, furthermore, is preferably coded, for example by mechanical coding, to error proof automated priming system 10. In the illustrated embodiment, base 80 includes projecting ribs 112, 120 and a recess 122 for mechanically coding applicator assembly 13, which will be more fully described below. Alternately or in addition, base 80 may include a plurality of openings 82*b*, depressions, or a magnetic strip or strips, or the like which provide a code for each respective applicator assembly 13. These openings or magnetic strips are then sensed by robot 11 so that robot 11 can confirm the identification of the respective applicator assembly. In this manner, each adapter assembly 13 may be supplied with a different treatment liquid or primer solution and yet robot 11 will be able to differentiate between the adapter assemblies and to identify the desired liquid to be applied to the substrate 15.

Figure 10:
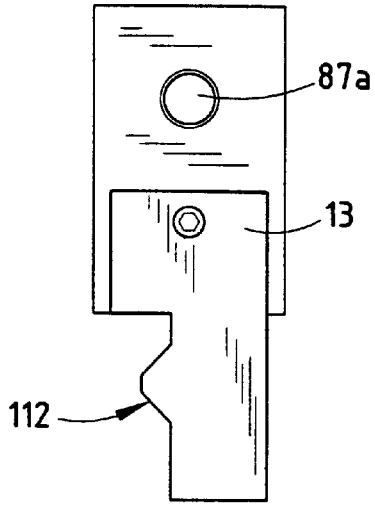
FIG. 10 is a top plan view of the base and adapter of FIG. 5.
Figure 11:
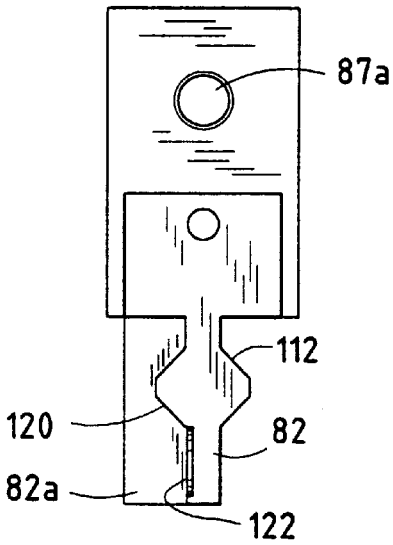
FIG. 11 is a bottom plan view of the base and adapter of FIG. 5.
Figure 12:
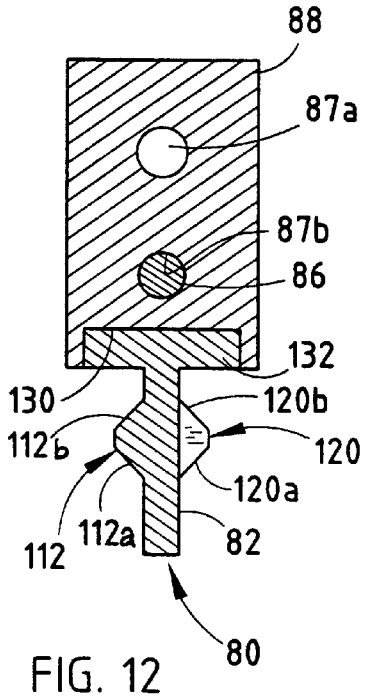
FIG. 12 is a cross-sectional view taken along line XIII—XIII of FIG. 7.

In the illustrated embodiment, adapter base 80 includes an elongated longitudinally extending rib 112 on web 82 which extends from an upper surface 114 of web 82 to a lower surface 116 of web 82. On an opposed side 118 of web 82 is a truncated elongated rib 120 which extends from upper surface 114 to a medial portion of web 82. Adjacent rib 120, web 82 is also provided with a recessed groove 122 which extends from upper surface 114 of web 82 to a second medial portion of base 80 and extends generally parallel with and adjacent to projecting rib 120. Furthermore, ribs 112 and 120 each include tapered sides 112*a*, 112*b* and 120*a*, 120*b*, respectively. Preferably, tapered sides 112*a* and 112*b* and 120*a* and 120*b* are angled to provide a unique key for each respective adapter assembly 13. As best seen in FIG. 10, in the illustrated embodiment, tapered sides 112*a*, 112*b*, and 120*a*, 120*b* are symmetrical, but together with recess 122, form an asymmetrical cross-section for base 80. Preferably, each applicator assembly 13 is uniquely coded to its respective port so that robot 12 may uniquely identify each respective applicator assembly 13.

Additionally, as referenced above, docking station 12 preferably includes a receiving assembly 110 associated with each applicator assembly 13. Each receiving assembly 110 includes a pair of receiving members or jaws 110*a* and 111*a* (FIG. 3). Jaws 110*a* and 111*a* are keyed to the respective base 80 of the respective applicator assembly 13 so that each applicator assembly 13 has a unique position on docking station 12 to further error proof liquid applicator system 10. As best seen in FIG. 3A, receiving member 110*a* includes a base 110*b* for securing to upper wall 48 of housing 44 and a receiving portion 110*c* which includes a recess or groove 110*d* which matches the profile of the mechanically coded base 80 of the respective applicator assembly 13. Similarly, receiving member 111*a* includes a base 111*b* for securing to tank upper wall 44 and a receiving portion 111*c* with a groove or recessed portion 111*d* for the rib on base 80. In this manner, each applicator assembly 13 can only be properly aligned and positioned on docking station 12 when the receiving members 110*a* and a 111*a* match the mechanical coding on base 80. When liquid applicator 10 is used for applying one or more primer solutions, receiving assemblies 110 are preferably aligned and adjacent to the respective vapor ports 50 so that when the applicator assemblies are positioned in the receiving assemblies 110, their respective tips 13*b* are aligned and positioned in vapor ports 50.

Thus, docking station 12 at least provides a means for positively locating the respective applicator assemblies between the application process so that robot 11 will be able to repeatably locate a respective applicator assembly. In a primer application process, docking station 12 preferably further provides a means for preventing the primer solution from prematurely drying and, in addition, closes the primer supply system, thus reducing waste, contamination, and processing time. It should be understood that when automated liquid applicator system 10 applies a non-curing liquid or a liquid that does not harden when it dries the solvent in reservoir 42 may be eliminated. Furthermore, reservoir 42 may be omitted.

Referring again to FIGS. 3, 5, 6–9, and 12, fluid adapter 88 is movably and slidably mounted on shaft 86 in order to provide a floating fluid adapter which follows the contoured surface of a substrate 15; consequently, when applicator assembly 13 is positioned with shaft 86 assuming a generally vertical orientation, the weight of fluid adapter 88, operating under the force of gravity, induces a constant pressure to substrate with tip 13*a* to provide a consistent and uniform application of the treatment liquid or primer solution. Furthermore, by automating the process, applicator assembly 13 provides a repeatable application path and thickness. The weight and/or density of fluid block 88 is preferably selected so that applicator assembly 13 applies the appropriate pressure for the particular horizontal application. Alternately or in addition, the desired pressure can be achieved by providing a biasing member, such as spring 89 on shaft 86. In the illustrated embodiment spring 89 is positioned on shaft 86 between an upper flange 134 of C-shaped member 84 and fluid block 88. In this manner, spring 89 will provide a constant force on fluid block 88, which in turn will provide a constant pressure on substrate 15 with applicator tip 13*b*. Spring 89 is particularly useful when substrate 15 is supported in a generally vertical orientation, as would be understood by those skilled in the art.

In addition, to restrict fluid adapter 88 from excessive movement and twisting about base 80, fluid adapter 88 includes a channel shaped groove 130 (FIGS. 5 and 12) which rides along a flange portion 132 of C-shaped portion 84. Flange portion 132 guides fluid adapter 88 in a generally parallel relationship to shaft 86 and reduces the amount of play between fluid block 88 and base 80. Moreover, guide flange portion 132 assures the orthogonality of the applied pressure. In addition, ribs 112 and 120 are preferably aligned and generally parallel to each other and to shaft 86. In this manner, when robot 11 grips the respective applicator assembly, robot 11 can position applicator assembly 13 in a generally vertical orientation for a horizontally oriented substrate so that robot 11 can assure that tip 13*b* applies pressure in a direction orthogonal to substrate 15. Likewise, when substrate 15 is oriented in vertical orientation, robot 11 can rotate applicator assembly 13 such that fluid block 88 will be aligned in a generally horizontal place for applying pressure orthogonal to the substrate under the force of spring 89.

Figure 5:
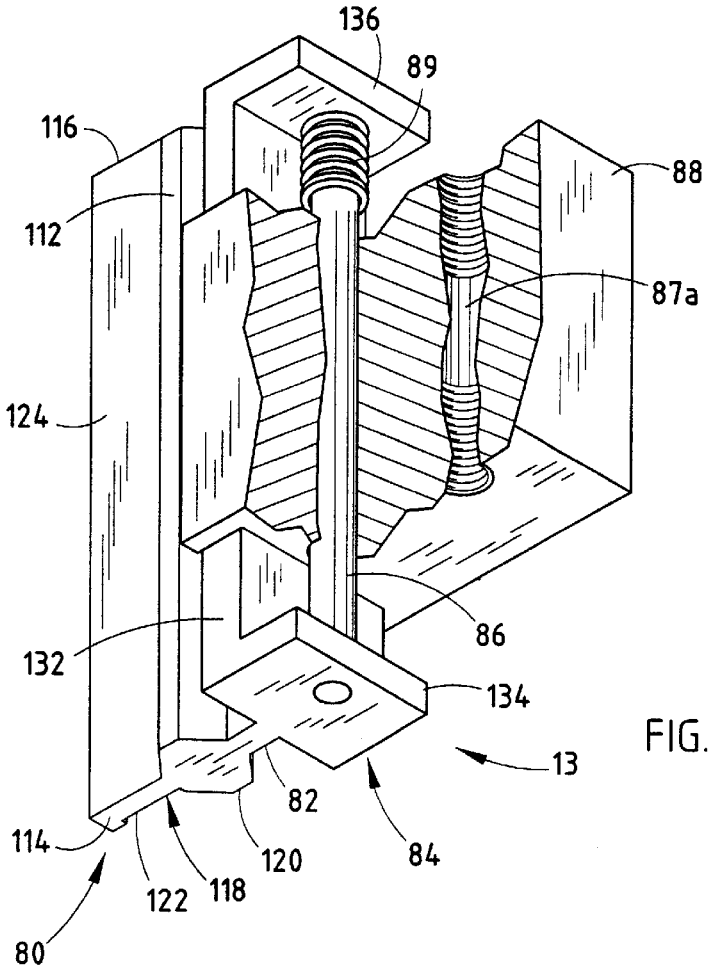
FIG. 5 is an enlarged perspective partial fragmentary view of the base and adapter of the applicator of FIGS. 1 and 3.
Figure 6:
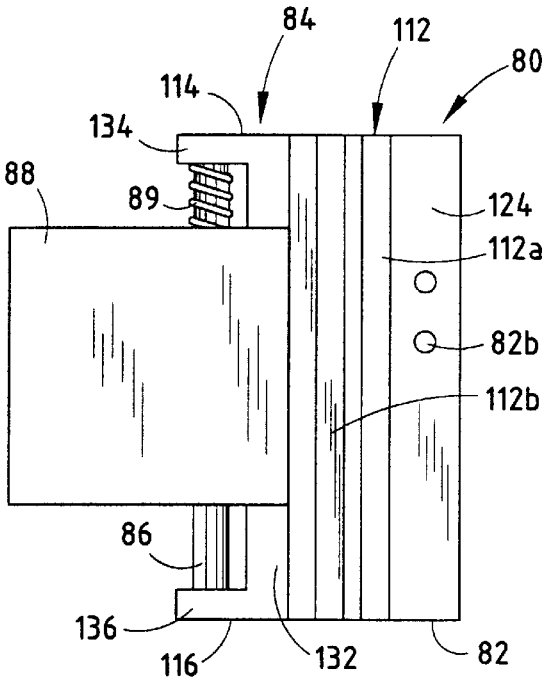
FIG. 6 is a first left side elevation view of the base and adapter of FIG. 5.
Figure 7:
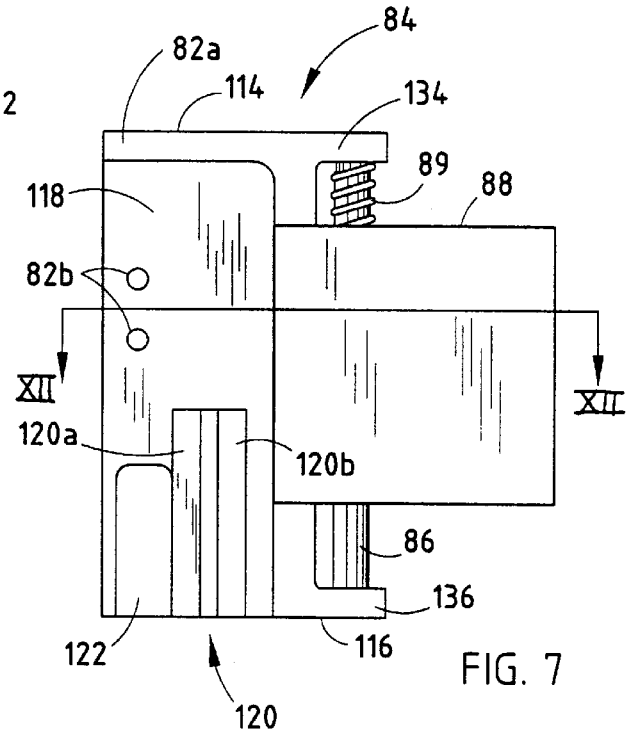
FIG. 7 is a second right side elevation view of the base and adapter of FIG. 5.
Figure 8:
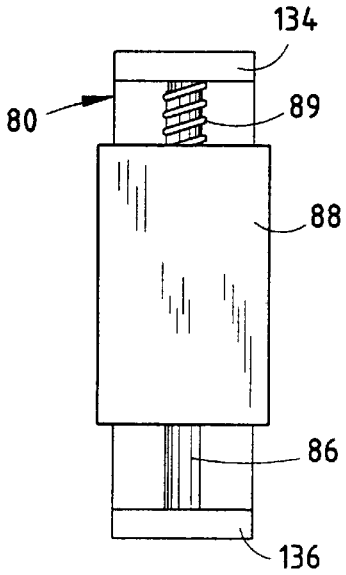
FIG. 8 is a front elevation view of the base and adapter of FIG. 5.
Figure 9:
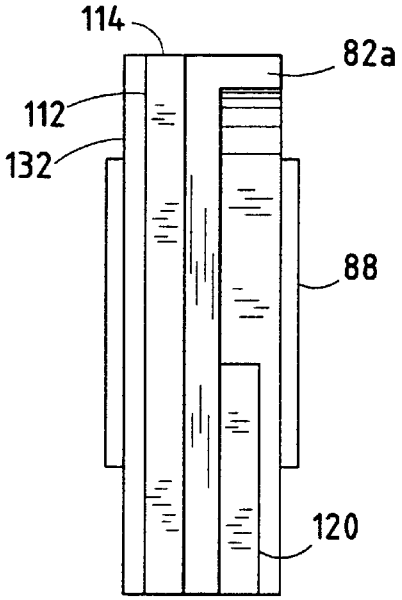
FIG. 9 is a back elevation view of the base and adapter of FIG. 5.

As best seen in FIG. 5, C-shaped portion 84 includes upper and lower flanges 134 and 136, between which shaft 86 is mounted. Flanges 134 and 136 provide stops and limit the movement of fluid adapter 88 therebetween and respectively define uppermost and lowermost positions for fluid adapter 88.

From the foregoing, it can be appreciated that a method of applying of treatment liquid or a primer solution to a substrate, such as a window assembly, is disclosed which includes holding a liquid applicator assembly. The liquid applicator assembly includes a liquid applicator and which is adapted to apply a constant pressure and flow of non-contaminated treatment liquid or primer to the substrate with the applicator. The applicator assembly is positioned on the substrate and the liquid is directed on to the substrate through the liquid applicator assembly and the liquid applicator. As described in reference to the apparatus of the present invention, the liquid applicator assembly is preferably stored in a docking station. Preferably, when applying a primer, the liquid applicator assembly is stored between applications in an environment which prevents premature hardening of the primer solution in the applicator assembly. The docking station optionally includes a reservoir and a vapor port which is in fluid communication with the reservoir, which holds a liquid primer solution solvent to prevent premature hardening of the primer solution in the applicator. Preferably the applicator assembly is positioned in the port of the reservoir such that the applicator is adjacent and engages solvent vapors in the reservoir but is out of contact with liquid solvent such that the primer solution in the applicator assembly does not prematurely harden. Furthermore, the substrate is preferably supported on a table or conveyor, such that the substrate is positively located. In this manner, the application of the liquid onto the substrate may be accomplished using robot 11, which is preprogramed to locate the respective applicator assembly and to position and guide the applicator assembly in a preprogrammed path on the substrate.

As described in reference to the liquid supply system, the liquid applicator assembly is preferably coupled to the supply system so that the liquid can be directed from the supply system through the applicator assembly directly on to the substrate. Furthermore, the supply system preferably recirculates the liquid through the primer supply system to maintain the homogenous properties of the treatment liquid or primer solution. In addition, by providing a plurality of applicator assemblies, more than one liquid can be applied to the substrate. In this way, robot 11 selects one of the applicator assemblies for applying a selective liquid onto the substrate. Moreover, to error proof the system, each applicator assembly is preferably coded so that each applicator assembly is uniquely identified.

As described in reference to robot 11, each applicator assembly is preferably gripped by a gripper which engages a base of the applicator assembly. Preferably the applicator tip is moveably mounted on the base so that the applicator assembly can apply a constant pressure to the substrate when applying the primer solution. However, it should be understood that robot 11 or gripper assembly 19 can be modified to apply a constant pressure to the substrate with the applicator. In addition, the applicator tip is preferably removable for service or replacement by releasably coupling the applicator tip to the base of the respective applicator assembly.

Accordingly, the present invention provides an automated liquid applicator system and method which applies a highly accurately placed coating of liquid on a desired portion of a substrate. In addition, the automated application system of the present invention applies a constant pressure despite the characteristics and the contoured surface of the substrate and, therefore, is able to achieve a uniform application path and thickness. Furthermore, after application, the automated liquid applicator system returns the applicator assembly to its respective location on the docking station to assure a repeatable process. When applying a primer, the automated liquid applicator system preferably returns the applicator assemblies to respective vapor ports for storage, which prevents premature hardening of the primer solution in the applicator and applicator tip. Optionally, the liquid applicator system selects another applicator for applying a second coating of a second treatment liquid or primer solution in a similar process.

While some forms of the invention have been shown and described, other forms will now become apparent to those skilled in the art. For example, while the present invention has been described primarily in reference to a primer applicator system, it should be understood that system 10 is suitable for applying various liquids, as mentioned above, including treatment liquids, such as acid solutions and cleaning solutions, and the like. Further, while reference is made to a robot having a gripper for holding the applicator, it should be understood that a gripper may be held by a person or held by a power-assist tool which is guided by a person. Moreover, while the description describes the application assembly including a spring for vertical substrate applications (applications where the substrate is positioned in a non-horizontal plane), a spring can also be used in horizontal substrate applications where the spring is selected based on the desired pressure to be applied to the substrate. Furthermore, the shape and/or location of ribs 112, 120 and recess 122 and openings 82*b* can be varied. Therefore, it will be understood that the embodiments shown in the drawing and described above are merely for illustrative purposes, and are not intended to limit the scope of the invention which is defined by the claims which follows at the end of the description.

We claim:

1. An applicator assembly for use in an automated liquid applicator system for applying a liquid to a substrate, said applicator assembly comprising:

a base adapted for being held by a gripper, said base including a pin;

a liquid applicator movably mounted on said base and slidably mounted on said pin by an adapter, said base including a pair of flanges, said flanges providing stops and limiting the movement of said adapter between a first position and a second position along said pin, said liquid applicator being adapted to receive a supply of liquid and being positionable on he substrate by the grinder for approving the liquid to the substrate said adapter including a transverse supply passage for receiving the liquid, said applicator, being mounted to said adapter and being in communication with said transverse supply passage for receiving the liquid through said transverse supply passage, and said liquid applicator moving on said base to follow the contour of the substrate thereby applying a constant pressure to the substrate during a liquid application process.

2. The applicator assembly according to claim 1, wherein said liquid applicator is removably mounted to said adapter.

3. The applicator assembly according to claim 2, wherein said adapter includes an applicator fitting removably mounted thereon, said applicator fitting including said liquid applicator.

4. The applicator assembly according to claim 3, wherein said liquid applicator includes a mounting portion and a flange portion, an applicator tip being coupled to said flange portion.

5. The applicator assembly according to claim 4, wherein said applicator tip comprises a pad, said pad absorbing the liquid for applying the liquid onto the substrate.

6. The applicator assembly according to claim 5, wherein said pad comprises a felt pad.

7. The applicator assembly according to claim 4, wherein said applicator fitting extends into said mounting portion of said liquid applicator and is coupled thereto by a friction fit whereby said applicator tip is removable for cleaning or replacement.

8. The applicator assembly according to claim 7, wherein one of said applicator fitting and said mounting portion includes an annular seal, said annular seal providing a fluid tight connection between said applicator fitting and said applicator.

9. The applicator assembly according to claim 1, wherein said adapter includes a second transverse passage, said second passage receiving said pin.

10. The applicator assembly according to claim 9, wherein said adapter comprises a block member.

11. The applicator assembly according to claim 1, wherein said pin extends between said flanges.

12. The applicator assembly according to claim 1, further comprising a biasing member, said biasing member being mounted on said pin and being positioned between one of said flanges and said adapter to bias said liquid applicator for contacting the substrate with a substantially constant pressure.

13. The applicator assembly according to claim 12, wherein said biasing member comprises a spring.

14. The applicator assembly according to claim 1, further comprising a liquid supply line, said liquid supply line being coupled to said adapter and delivering liquid to said applicator through said transverse supply passage.

15. The applicator assembly according to claim 14, wherein said supply line is coupled to said adapter by a supply line fitting.

16. The applicator assembly according to claim 15, wherein said fitting comprises a male fitting.

17. The applicator assembly according to claim 1, wherein said base is coded to uniquely identify said applicator assembly.

18. The applicator assembly according to claim 17, wherein said base is mechanically coded.

19. The applicator assembly according to claim 1, wherein said liquid applicator includes a liquid applicator tip, said liquid applicator tip absorbing the liquid for applying the liquid onto the substrate.

20. An applicator assembly for use in an automated liquid applicator system for applying a liquid to a substrate, said applicator assembly comprising:

a base adapted for being held by a gripper, said base including a pin and said pin supporting a biasing member; and a liquid applicator movably mounted on said base and being slidably mounted on said base by said pin, said liquid applicator being adapted to receive a supply of liquid and being positionable on the substrate by the gripper for applying the liquid to the substrate, said adapter including a transverse supply passage for receiving the liquid, said applicator being mounted to said adapter and being in communication with said transverse supply passage for receiving the liquid through said transverse supply passage, said biasing member biasing said adapter for applying a constant pressure to the substrate, and said liquid applicator moving on said base to follow the contour of the substrate thereby applying a constant pressure to the substrate during a liquid application process.

21. The applicator assembly according to claim 20, wherein said liquid applicator includes an absorbent applicator tip, said absorbent applicator tip absorbing the liquid for applying the liquid to the substrate.

22. The applicator assembly according to claim 21, further comprising a biasing member, said biasing member urging said liquid applicator for contacting the substrate with said applicator tip with a substantially constant pressure.

23. The applicator assembly according to claim 22, wherein said biasing member comprises a spring.

24. An applicator assembly for use in an automated liquid applicator system for applying a liquid to a substrate, said applicator assembly comprising:

a base adapter for being held by a gripper, said base being mechanically coded to uniquely identify said applicator assembly, said base being mechanically coded by a projecting rib; and a liquid applicator movably mounted on said base, said liquid applicator being adapted to receive a supply of liquid and being positionable on the substrate by the gripper for applying the liquid to the substrate, and said liquid applicator moving said base to follow the contour of the substrate thereby applying a constant pressure to the substrate during a liquid application process.

25. The applicator assembly according to claim 24, wherein said projecting rib includes an asymmetrical cross-section.

26. The applicator assembly according to claim 24, said base including a second projecting rib for further providing mechanical coding of said applicator assembly.

27. The applicator assembly according to claim 26, wherein each of said first and second projecting ribs includes a cross-section, said cross-section of said first projecting rib being different from said cross-section of said second projecting rib.

28. The applicator assembly according to claim 23, wherein said liquid applicator is movably mounted on said base by an adapter, sad adapter including a transverse supply passage for receiving the liquid, said liquid applicator being mounted to said adapter and being in communication with said transverse supply passage for receiving the liquid through said transverse supply passage.

29. The applicator assembly according to claim 28, wherein said applicator tip comprises a pad, said pad absorbing the liquid for applying the liquid onto the substrate.

30. The applicator assembly according to claim 24, wherein said liquid applicator includes an absorbent liquid applicator tip, said liquid applicator tip absorbing the liquid for applying the liquid to the substrate.

31. The applicator assembly according to claim 30, wherein said applicator tip comprises a pad.

* * * * *

UNITED STATES PATENT AND TRADEMARK OFFICE

CERTIFICATE OF CORRECTION

PATENT NO. : 6,228,168 B1
DATED : May 8, 2001
INVENTOR(S) : William A. Johnson

It is certified that error appears in the above-identified patent and that said Letters Patent is hereby corrected as shown below:

Column 13,
Line 64, “he” should be -- the --
Line 65, “grinder” should be -- gripper --
Line 65, “approving” should be -- applying --
Line 67, delete “,” after “applicator”

Column 15,
Line 33, “adapter” should be -- adapted --

Column 16,
Line 5, insert -- on -- after “moving”
Line 21, “sad” should be -- said --

Signed and Sealed this

Second Day of November, 2004

JON W. DUDAS
*Director of the United States Patent and Trademark Office*